United States Patent [19]

Bhangu et al.

[11] 4,168,348

[45] Sep. 18, 1979

[54] PERFORATED LAMINATED MATERIAL

[75] Inventors: Jagnandan K. Bhangu, Ockbrook; Brian D. Edwards, Prestbury, both of England

[73] Assignee: Rolls-Royce Limited, London, England

[21] Appl. No.: 848,026

[22] Filed: Nov. 3, 1977

Related U.S. Application Data

[63] Continuation-in-part of Ser. No. 640,565, Dec. 15, 1975, abandoned.

[30] Foreign Application Priority Data

Dec. 13, 1974 [GB] United Kingdom ..... 53892/74

[51] Int. Cl.[2] ..... F01D 5/18

[52] U.S. Cl. ..... 428/573; 60/39.65; 60/39.69 R; 416/90 R; 416/95; 416/97 A; 428/594; 428/586

[58] Field of Search ..... 416/90 R, 95, 97 A; 428/573, 594, 586; 60/39.65, 39.69

[56] References Cited

U.S. PATENT DOCUMENTS

| | | | |
|---|---|---|---|
| 3,584,972 | 6/1971 | Bratkovich et al. | 416/229 |
| 3,620,643 | 11/1971 | Jones | 416/90 |
| 3,864,199 | 2/1975 | Meginnis | 416/90 |
| 4,004,056 | 1/1977 | Carroll | 29/191.4 |

*Primary Examiner*—Brooks H. Hunt

*Attorney, Agent, or Firm*—Cushman, Darby & Cushman

[57] ABSTRACT

A material suitable for making combustion chambers for gas turbine engines comprises at least two abutting sheets of perforated material, the perforation being out of alignment and interconnected by a series of channels formed on one or both of the abutting surfaces of abutting sheets. The total cross-sectional area of the perforations in at least one sheet is at least double the total cross-sectional area of the perforations in the remaining sheets or sheets per unit area.

6 Claims, 5 Drawing Figures

PERFORATED LAMINATED MATERIAL

Figure 1:
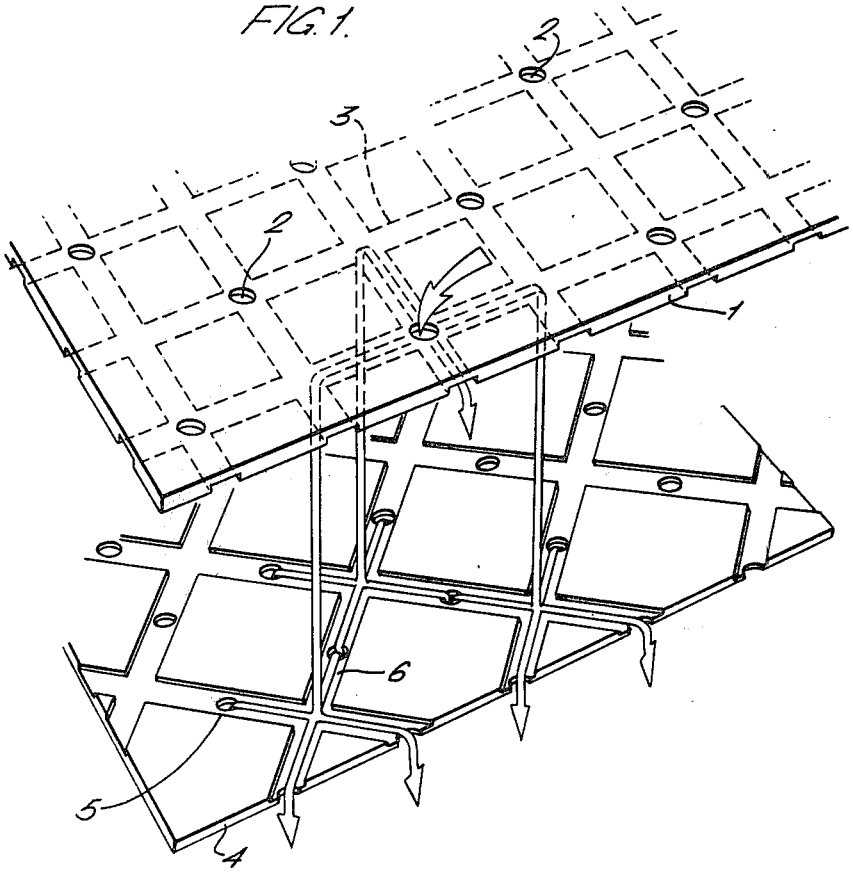

This application is a continuation-in-part application of the copending United States application Ser. No. 640,565, filed Dec. 15, 1975, now abandoned.

This invention relates to perforate laminated material which is particularly suitable for use in high temperature parts of gas turbine engines, although the invention is not restricted thereto.

Turbine entry temperatures of gas turbine engines have risen sharply over the last few years and will continue to rise mainly because of the need to produce gas turbine engines with higher thrust and more economical performance. The thermal efficiency i.e. the power output and fuel consumption can be improved by higher compressor pressures and higher combustion temperatures. Higher compressor pressure will in turn give rise to higher compressor outlet temperatures and higher pressures in the combustion chamber and hence higher compressor delivery temperatures and combustor heat releases will make it progressively more difficult to maintain the combustion chamber wall at an acceptable temperature level which is fixed by the mechanical and thermal properties of the metal.

It is an object of the present invention to provide a material capable of withstanding such higher temperatures.

According to the present invention perforate laminated material comprises first and second abutting sheets of high temperature resistant material bonded together in face-to-face relationship, each of said sheets being provided with a plurality of perforations the perforations of the adjacent sheets being out of alignment, at least one of the abutting surfaces of the sheets being provided with channels defining passageways in the material interconnecting the perforations of the first sheet with the perforations in the second sheet, said perforations in said first sheet being operable to meter the flow of a fluid through the material whereby discrete flows of fluid pass through said perforations and impinge upon the inside surface of said second sheet, the total cross-sectional area of the perforations in said second sheet being at least double the total cross-sectional area of the perforations in the said first sheet in a predetermined area of the material whereby the fluid is not metered therethrough, and the perforations in the second sheet are operable to produce a film of fluid adjacent to the outer surface of said second sheet over said predetermined area.

The perforations amy comprise circular holes of the same or different diameters, in the former case there being at least twice as many holes in at least one sheet as in any of the other sheets over a predetermined area.

The holes may be evenly distributed or randomly distributed and the number of holes over a predetermined area may vary over the surfaces of the sheets.

The perforations in at least one of the sheets may be any suitable shape other than circular holes and conveniently may be rectangular slots.

In a preferred embodiment perforate laminated material comprises two sheets one being provided with holes and the other being provided with rectangular slots, the total cross-sectional area of the slots being at least twice the cross-sectional area of the holes over a predetermined area. The rectangular holes are preferably arranged parallel to each other.

It is intended that the perforate laminated material is used with the sheet with the larger cross-sectional area of perforations exposed to high temperatures, and the sheet with the smaller cross-sectional area of perforations exposed to a flow of cooling fluid.

To retain a layer of cooling fluid adjacent to the sheet with the smaller cross-sectional area of perforations an imperforate sheet may be located adjacent to this sheet so as to leave a cooling fluid space between the sheets.

The imperforate sheet may be spaced from the perforate sheet by suitable ribs or spacers either bonded to the sheets or formed integrally with one of the sheets.

Figure 2:
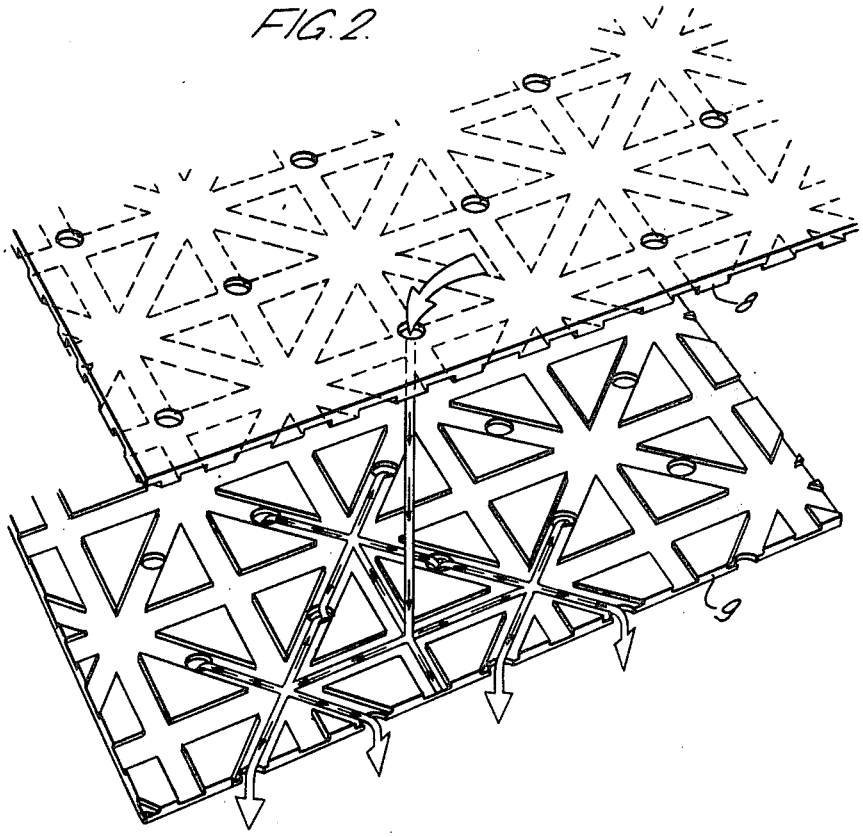
Figure 3:
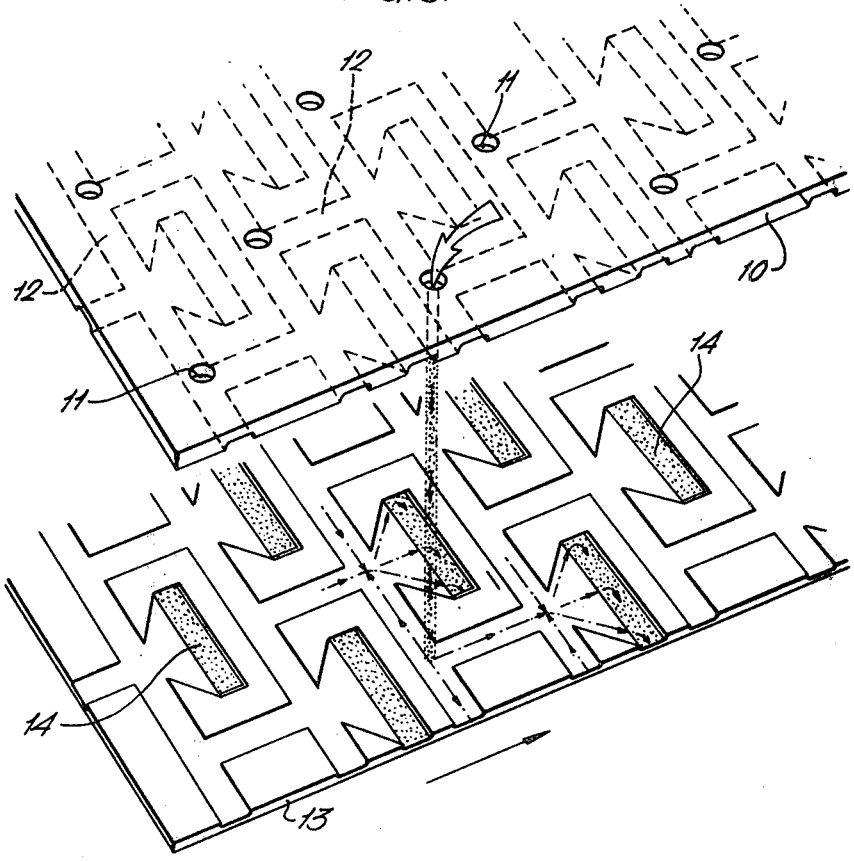
Figure 4:
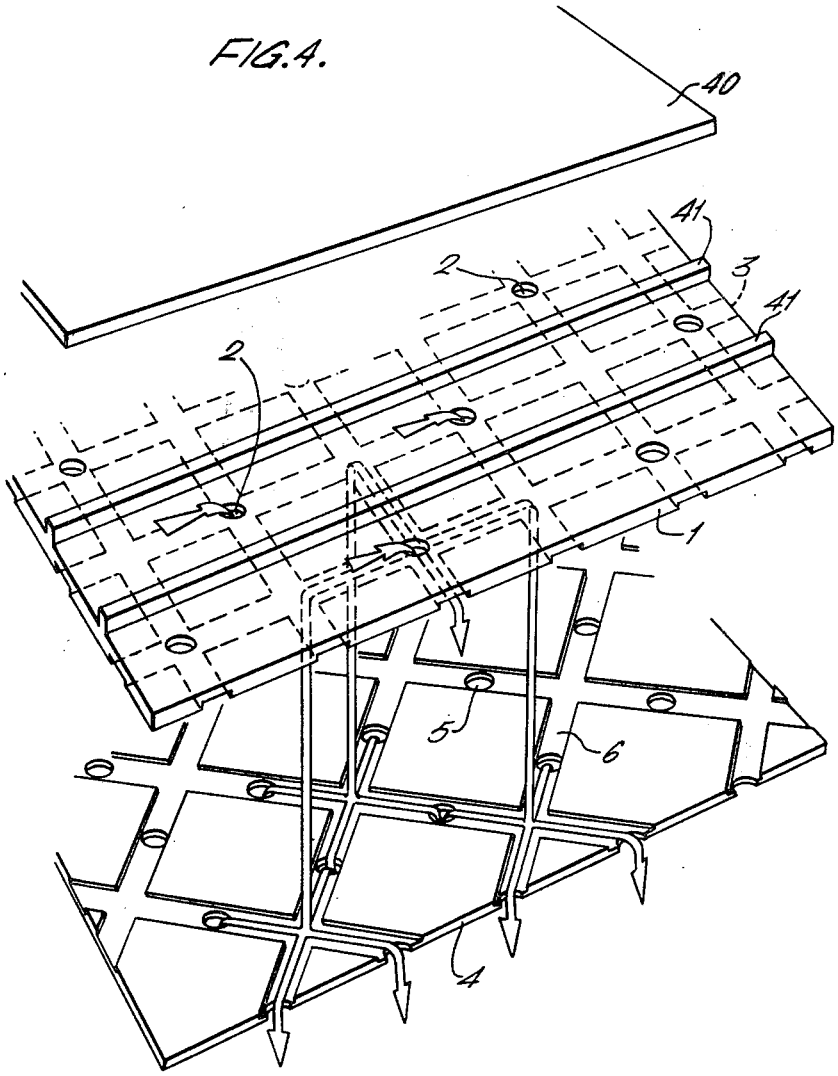
Figure 5:
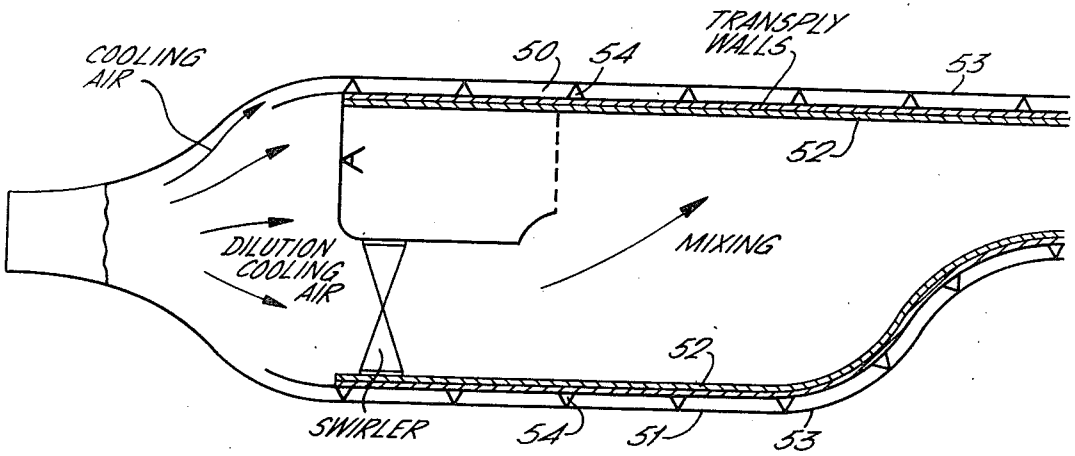

Embodiments of the invention will now be described by way of example only with reference to the accompanying drawings in which:

FIG. 1 illustrates a perforate laminated material constructed in accordance with the invention, FIG. 2 illustrates a similar material with a different arrangement of channels, FIG. 3 illustrates a perforate laminated material with one sheet provided with slots, FIG. 4 illustrates an arrangement consisting of two sheets of perforate material and a third sheet of imperforate material and FIG. 5 illustrates a gas turbine engine combustion chamber made from perforate laminated material in accordance with the invention.

FIG. 1 is an exploded view of a two sheet perforate laminated material. Sheet 1 is provided with a series of symmetrically arranged holes 2 and a series of symmetrically arranged interconnecting channels 3. The channels 3 are formed in one surface only, the holes 2 and the channels 3 having been produced by electrochemical etching with the holes 2 being positioned at alternate intersections along the channels 3 with the holes in one channel being interdigitated with the holes in the adjacent channels. Sheet 4 is also provided with a series of symmetrically arranged holes 5 and interconnecting channels 6, the channels again being formed in one surface only but there are twice as many holes per unit area in sheet 4 as in sheet 1. The holes 5 are positioned in the sheet 4 to pass through the sheet midway between the intersections of the channels 6.

The sheets are brazed together in face-to-face relationship on the contacting areas between the channels 3 to 6 with the channels and the holes out of alignment.

It will be seen that the channels are arranged in a square pattern on each sheet, but the width of the squares is slightly greater on sheet 4 and the sheets are brazed together with the channels disposed diagonally relative to each other and with their intersections in the channels 3 which do not possess holes 2, being positioned opposite the intersections in the channels 6. It will thus be seen that a fluid, such as air, is metered through the holes 2 as shown by the arrows and impinges on the inner surface of the sheet 4. The flow of air is then split into four parts and flows radially away from the hole along the channels 3. The air flows into the channels 6 at the overlying intersections of the channels 3 and 6 and is again split into four radial parts before passing through the sheet 4 via the holes 5. This tortuous flow path enables the air efficiently to cool large areas of the sheets when they are exposed to high temperatures, the degree of cooling being dependent upon the dimensions of the holes and channels, their spacings and their numbers. The majority of the cooling effect is achieved however by the impingement of the flow of metered air on the sheet 4.

It is intended that the sheet 4 with the larger number of holes 5 is exposed to higher temperatures and cooling air is supplied to the sheet 1. The larger number of holes in sheet 4 permits an even distribution of cooling air over the outer surface of sheet 4 effectively to provide a film of cooling air. The larger number of holes also has no metering effect on the flow of air.

The sheets can be made of any suitable high temperature material such as nickel alloy.

FIG. 2 is an exploded view of perforate laminated material substantially the same as shown in FIG. 1 but in this case both sheets are provided with a similar array of interconnecting transverse and diagonal channels but the arrangements of holes in the top sheet 8 is identical to that of sheet 1 of FIG. 1 and that of lower sheet 9 is identical to that of sheet 4 of FIG. 1.

In FIG. 3 there is shown an exploded view of perforate laminated material consisting of a sheet 10 provided with holes 11 which communicate with a series of channels 12 formed in one surface of the sheet 10; a second sheet 13 is provided with a symmetrical arrangement of transverse parallel slots 14 extending through the sheet and a series of channels 15 which correspond with the channels 12 in the sheet 10. It will be seen that when the sheets are brazed together air entering the holes 11 as at arrow 16 will find it easiest to travel transversely of the sheets and in a direction from left to right in the drawing to escape through the slots 14. A film of air will thus emanate from each slot travelling from left to right and form a cooling film of air along the outer surface of the sheet 13. Since there is a degree of overlap between the slots 14 the separate films emerging from the slots form a film of air across the entire outer surface of the sheet 13.

It will be appreciated that many other arrangements can be made which fall within the scope of the invention. Thus the holes may not be symmetrically arranged and the number of holes in a predetermined area of material may vary along a sheet. The holes or slots in a predetermined area in one sheet is at least double the total cross-sectional area of the other sheet.

FIG. 6 is the same as the embodiment shown in FIG. 1, but is adapted to have a further imperforate sheet 40 secured adjacent to the outer sheet 1. The sheet 1 is provided with spacing ribs 41 to which the sheet 40 is brazed. A supply of cooling fluid is then directed between the sheet 1 and 40. The ribs 41 may be formed integrally with the sheet 1 or 40 or may be separate pieces brazed to both sheets. Alternatively the sheets may be spaced apart by a plurality of projections formed on one of the sheets or brazed to the sheets. Airflow is as shown by arrows.

FIG. 5 is a part cross-sectional view of a gas turbine engine combustion chamber which is constructed from the material shown in FIG. 4.

The combustion chamber is annular in shape with an annular outer wall 50 and an annular inner wall 51. The walls 50 and 51 consist of two-sheet perforate laminated material 52 with an outer imperforate sheet 53 spaced therefrom by a series of spacers 54. Cooling air is directed through the space between the imperforate sheet 53 and the two-sheet perforate laminated material 52 and passes through the perforate laminated material to form a cooling film on the inner surface thereof.

It will be appreciated that the perforate laminated material is suitable for many components which are exposed to high temperatures.

We claim:

1. A perforate laminated material comprising first and second abutting sheets of high temperature resistant material having abutting surfaces bonded together in face-to-face relationship, each of the said sheets being provided with a plurality of perforations, the perforations in the adjacent sheets being out of alignment, at least one of the abutting surfaces of the sheets being provided with channels defining passageways in the material interconnecting said perforations of said first sheet with said perforations in said second sheet, said perforations in said first sheet being operable to meter the flow of a cooling fluid successively through said first and second sheets, whereby discrete flows of fluid pass through said perforations in said first sheet and impinge upon the inside surface of said second sheet, the total cross-sectional area of the perforations in said second sheet being at least double the total cross-sectional area of the perforations in the first sheet in a predetermined area of material whereby the velocity of the fluid passing through said second sheet perforations is less than that passing through said first sheet perforations and the fluid emitted from said second sheet perforations, tends to coalesce and substantially produce a film of fluid adjacent to the outer surface of said second sheet over said predetermined area.

2. A perforate laminated material as claimed in claim 1 in which the perforations of the first and second sheets comprise circular holes having the same diameter, said second sheet having at least twice as many holes as said first sheet in a predetermined area of the material.

3. A perforate laminated material as claimed in claim 1 in which the perforations of each of said sheets comprise holes and in which the holes in each sheet are evenly distributed over the surfaces of the sheet.

4. A perforate laminated material as claimed in claim 1 in which the perforations in each of said sheets comprise holes, the holes in each sheet being randomly distributed over the surfaces of the sheets.

5. A perforate laminated material as claimed in claim 1 in which the perforations in said first sheet comprise circular holes, and the perforations in said second sheet comprise rectangular slots.

6. A perforate laminated material as claimed in claim 5 in which said rectangular slots are arranged parallel to one another.

* * * * *